United States Patent [19]

Mahner

[11] 4,172,257

[45] Oct. 23, 1979

[54] GROUND STATION ANTENNA FOR SATELLITE COMMUNICATION SYSTEMS

[75] Inventor: Helmut Mahner, Haar, Fed. Rep. of Germany

[73] Assignee: Siemens Aktiengesellschaft, Berlin & Munich, Fed. Rep. of Germany

[21] Appl. No.: 815,830

[22] Filed: Jul. 14, 1977

[30] Foreign Application Priority Data

Jul. 20, 1976 [DE] Fed. Rep. of Germany ..... 2632615

[51] Int. Cl.[2] ..... H01Q 3/26

[52] U.S. Cl. ..... 343/854

[58] Field of Search ..... 343/840, 854, 100 ST, 343/778, 779, DIG. 2

[56] References Cited

U.S. PATENT DOCUMENTS

| | | | |
|---|---|---|---|
| 2,464,276 | 3/1949 | Varian | 343/854 |
| 2,703,842 | 3/1955 | Lewis | 343/840 |
| 3,160,887 | 12/1964 | Broussaud et al. | 343/854 |
| 3,267,472 | 8/1966 | Fink | 343/854 |
| 3,852,763 | 12/1974 | Kreutel et al. | 343/DIG. 2 |
| 3,881,178 | 4/1975 | Hannan | 343/840 |

*Primary Examiner*—Eli Lieberman

*Attorney, Agent, or Firm*—Hill, Van Santen, Steadman, Chiara & Simpson

[57] ABSTRACT

A ground station for satellite communication transmission systems which utilize a beam which is relatively narrow in the "hour angle direction" and is relatively wide in the "declination angle direction" so as to prevent interference from satellites on geostationary orbits and resulting in an antenna which is longer in the longitudinal direction than it is in the transverse direction, thus, making it easy to move from place to place without disassembly.

1 Claim, 5 Drawing Figures

GROUND STATION ANTENNA FOR SATELLITE COMMUNICATION SYSTEMS

BACKGROUND OF THE INVENTION

1. Field of the Invention

This invention relates in general to antenna and in particular to ground station antenna for a satellite communication system.

2. Description of the Prior Art

As satellite communication transmission systems have become more and more prevalent, it has become desirable to replace large highly directive antenna with cheaper and more mobile antennas due to the extreme cost of the large highly directive antenna.

SUMMARY OF THE INVENTION

The present invention relates to a ground station antenna for a communication satellite transmission system which can be aligned with its axis in the main beam direction toward a point predetermined by the position of the satellite on its geostationary orbit.

In satellite communication transmission systems, ground stations provided with relatively small antenna having relatively weak directivity are being used to an increasing extent. This allows the cost for a ground station to be considerably reduced over the large highly directive antenna previously used. Ground stations having relatively small weakly directive antenna can be transported and assembled more easily than large highly directive antennas. The automatic tracking of satellites by the antenna can also be considerably simplified or even dispensed with entirely in certain instances. In an extended satellite communication network, simpler ground stations allow substantial reductions in cost even when the resulting additional cost for the satellite are considered.

The large number of satellite communication networks in operation and in the planning stage necessitate that the best possible exploitation of the frequency ranges be assigned to satellite broadcasting and of the available satellite locations on the geostationary orbit. Under these conditions, high gain, sharply focused antenna must be given preference. Stations provided with weak focusing antenna will in fact act as interferences to other satellites or will suffer interference from such satellites. With equal effective radiated power, weakly focusing antenna will emit more power and thus more interference power than stations having more sharply focused antenna. Also, for reception, weakly focused antennas require a higher power flux density of the electrical energy emitted from the satellite on the earth's surface. If the extent of these undesired effects are to remain as limited as possible any reduction in the antenna dimensions at the ground stations in systems of this type, is controlled by relatively narrow limits.

Therefore, the diameters of the reflectors of small antenna generally are at least three to four meters. Antenna of this type must be disassembled for transportation. The antenna requires a supporting structure which supports the reflector to be set up obliquely in a plane having a predetermined direction (azimuth) and inclination.

The object of the present invention is to provide a ground station antenna which is used in a satellite communication network and provides beam widths of different dimensions in two planes perpendicular to each other so as to produce good exploitation of the geostationary orbit of a satellite and provides a lower cost antenna and the dimensions of the antenna allows it to be transported in the assembled state or alternatively allow it to be disassembled and reassembled in a very simple and time saving manner.

The object of the invention is realized in a ground station antenna for a satellite communication transmission system which is aligned with its axis in the main beam direction approximately to the point determined by the satellite position of its geostationary orbit and where according to the invention the antenna beam in a first sectional plane has a radiation diagram wherin the 3-dB-beam width points are between 0.2° to 2°. In a second sectional plane at right angles to the first plane, the antenna beam width has a 3-dB points a beam width of between 2° and 20° and the ratio of the first to the second 3-dB beam width is equal to or less than 0.25. The alignment of the first sectional plane corresponds at least approximately with the plane which is set by the antenna axis in the main beam direction and by a tangent to the geostationary orbit in the point of intersection with this axis.

Antennas having asymmetrical radiation patterns in which the 3-dB-beam widths are different in horizontal and vertical planes are known in numerous embodiments in the radar technology field. For example, reference can be made to the book by E. Kramar entitled "Funksysteme fuer Ortung und Navigation" published by Berlin Union GmbH, Stuttgart, pages 296 and 297. However, it is not known in the art to use such antenna having different beam widths in planes at right angles to each other for relatively small weakly focused antenna for ground stations in satellite communication networks.

The object of the present invention is based on the recognition that in order to achieve optimum exploitation of the geostationary orbit for a plurality of satellites and so as to avoid mutual interference between various satellite systems, the beam width need be only of short dimensions only in that plane which is set by the antenna axis in the main beam direction and by a tangent to the geostationary orbit in the intersection point with this axis. This plane which is at least approximately identical to the first sectional plane of the radiation diagram of the antenna will be referred to as "hour angle plane" and the second sectional plane at right angles thereto will be referred to as the "declination plane". It is to be realized, of course, that the hour angle and declination are well known coordinates of the celestial coordinate system. Therefore, the beam width of the antenna beam only need to be short in the hour angle plane since the adjacent satellites which act as interference or can suffer interference lie in this plane. In the declination plane, on the other hand, it is possible to widen the antenna beam in order to keep the area and, thus, the outlay for the antenna sufficiently small so as to be as economical as possible for the relevant satellite communication system. Interference from other satellite systems do not occur in the declination plane.

The surface dimensions of an antenna which exhibits a considerably different 3-dB-beam width in two-sectional planes at right angles to each other inherently will exhibit a relatively small ratio of width to length. An antenna of this type considerably simplifies transportation which is obviously limited by rail and road profiles since increased dimensions inonly the longitudinal direction impedes transportation to a considerably lesser extent than increased dimensions in two dimensions at right angles to each other. Thus, with a given transportation profile, the antenna corresponding to the invention can be easily moved in an assembled form for antennas having considerable antenna gain values.

In a first preferred embodiment, the antenna is a reflector antenna whose main reflector represents an oblong, curved dish with a width to length ratio corresponding to the ratio of the first to the second 3-dB beam width.

In a second preferred embodiment, the antenna comprises a reflector antenna having a plurality of group radiators wherein the group radiators are arranged in a line next to each other.

A particular advantageous variation of the second embodiment, consists in that the overall arrangement is formed by a plurality of individual antenna each having approximate rotation symmetrical radiation diagrams and the individual radiators when arranged next to one another in a horizontal line allows precise alignment of the overall antenna by means of adjustable phase shift devices in the supply lines to the individual radiators. Due to the fact that they are mounted along a horizontal line, for example on a strip foundation or on the flat roof of a building, the expensive support construction which is required for conventional antenna which must be obliquely position, is superfluous. Also, the various components of the antenna arrangement of the invention are easily accessible for repair and maintenance as well as assembly and disassembly.

If the antenna of the invention is to be designed to be steerable for example because it must be selectively aligned to various geostationary satellites, it is advantageous to align the axis in such manner that the main beam direction of the antenna of a ground station is steered along the geostationary orbit of the satellite, thus, in the hour angle plane. Due to the considerable beam width in the declination plane, the antenna generally does not need to be moved in the declination plane. This also applies to those antenna which require automatic tracking in that tracking can occur only in the hour angle direction and need not be adjusted for differences in declination.

With a reflector antenna having a central radiator, the mobility of the antenna can be accomplished either by mechanical movement of the overall antenna or by mechanical movement of its primary radiator. When the antenna is constructed with group radiators, in addition to a mechanical movement of the overall antenna, an electrically controlled beam pivoting of the main antenna lobe is also possible.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure and in which:

DESCRIPTION OF THE PREFERRED EMBODIMENTS

Figure 1:
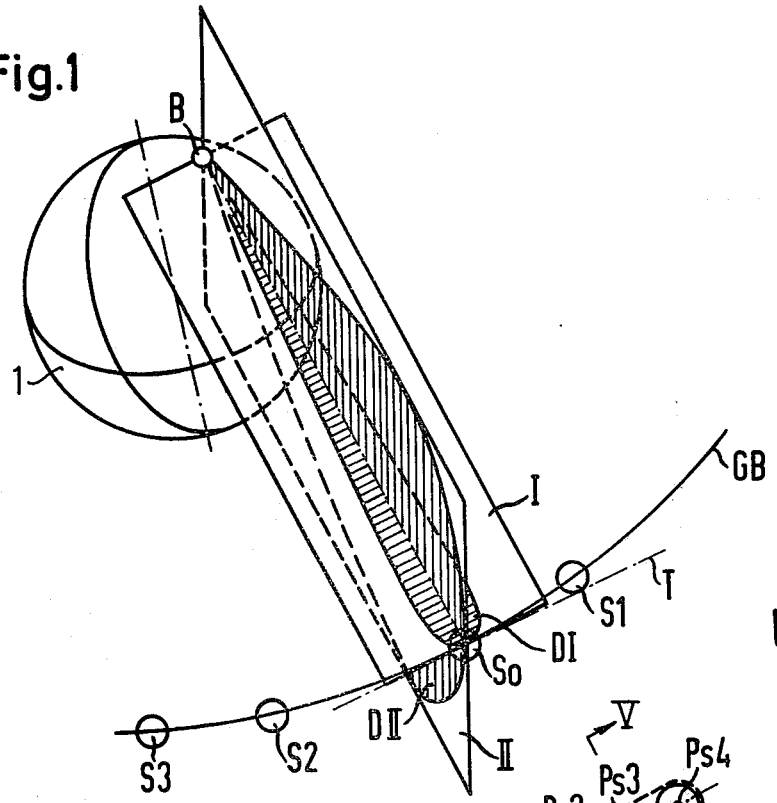
FIG. 1 schematically illustrates a satellite communication transmission system.

FIG. 1 shows a sphere 1 representative of the earth with a ground station B mounted thereon. The arc GB represents the geostationary orbit of a plurality of satellites indicates as S0, S1, S2 and S3, which are arranged on the geostationary orbit of various satellite networks. The ground station B cooperates with the satellite S0. The antenna of this ground station is aligned with its axis in the main beam direction to the satellite S0. In a first sectional plane I, which is a plane through which the arc GB approximately passes, the beam has a 3-dB beam width of between 0.2° and 2°. In a second sectional plane II, which is at right angles to the first sectional plane I, the antenna has a second 3-dB beam width of between 2° and 20°. The projection of the radiation diagram in the first and second sectional planes I and II, are indicated DI and DII. The first sectional plane I is referred to as the hour angle plane and coincides as can be seen from FIG. 1 with the plane which is set by the antenna axis in the main beam direction and a tangent T to the geostationary orbit GB at the point of intersection with this axis. In other words in the direction of the satellites S1 and S2 which are adjacent the satellite S0, the ground station B antenna has a small width and, thus, is relatively sharply focused whereas in the direction at right angles thereto, the focusing is not sharp. The lack of sharp focusing in the declination plane has virtually no effect upon interference with the adjoining satellites S1 and S2 as these do not lie in this plane. The relatively short dimensions of the antenna in the antenna cross-sectional plane governed by the declination plane, therefore, does not cause a correspondingly high degree of interference. Also, due to the fact that the antenna is not sharply focused in the declination plane, automatic tracking of the antenna in this plane can be dispensed with as the satellites will normally pass through the beam of the antenna in the declination plane without automatic tracking. So as to ensure sufficiently accurate alignment of the antenna to the satellite S0, if selective alignment to one of the adjacent satellites S1 to S3 is to be provided it is sufficient to design the antenna B so as to be moveable only in the hour angle plane.

Figure 2:
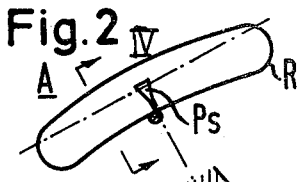
FIG. 2 illustrates a first exemplary embodiment of a ground station antenna corresponding to the invention in a satellite communication transmission system.
Figure 4:
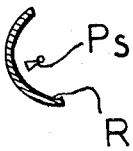
FIG. 4 is a sectional view taken on line IV—IV in FIG. 2.

In a first exemplary embodiment illustrated in FIGS. 2 and 4 of an antenna A, the antenna comprises a main reflector R which is formed as an oblong, curved dish as shown in sectional view 4. The main reflector R has a primary radiator PS located at its center and produces the desired radiation pattern having different widths as illustrated in FIG. 1. Thus, in the hour angle plane, the beam is narrow and in the declination plane at right angles thereto, the beam is relatively wide. The mobility of an antenna arrangement of the type illustrated in FIGS. 2 and 4 in the hour angle plane can be accomplished by simply providing that the dish R is moveable on the antenna platform along a curved track for example.

Figure 3:
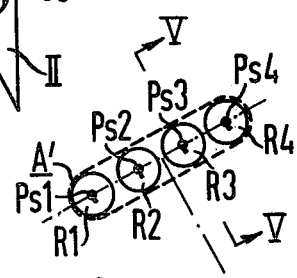
FIG. 3 illustrates a further embodiment of a ground station antenna for a satellite communication system.
Figure 5:
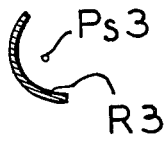
FIG. 5 is a sectional view taken on line V—V in FIG. 3.
Figure 5:
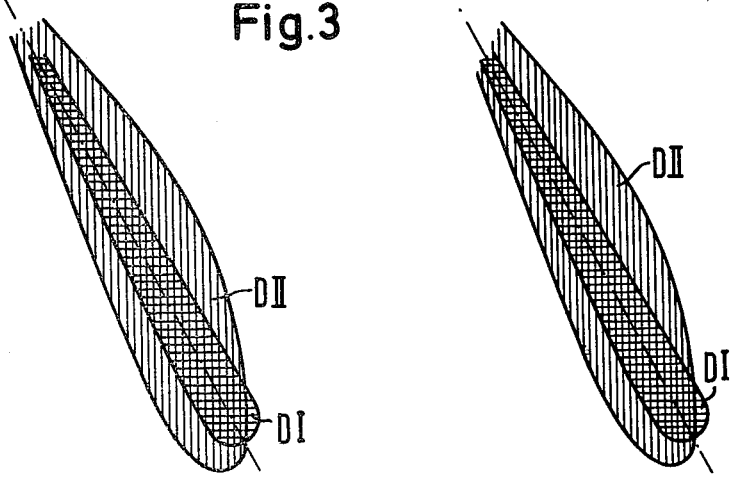

FIGS. 3 and 5 illustrate a modified form of an antenna A′ which consists of four rotational symmetrical parabolic main reflectors R through R4 which have primary radiators Ps1 through Ps4. The primary radiators are commonly fed by a high frequency source in such a manner that when the radiation of the reflectors R1 to R4 are combined to form the antenna A' the reflector antenna produce the desired beam widths of different widths in the hour angle plane and in the declination plane at right angles thereto. As shown in FIG. 5, the reflectors R1 to R4 have the same cross-sectional shape and are rotation symmetrical and are arranged in a straight line. The erection of the four individual reflector antennas presents no particular difficulties as they simply must be arranged along a straight line so as to produce the desired overall radiation pattern illustrated.

The precise alignment of the antenna A' can be accomplished by utilizing four adjustable phase shift devices in the individual feed lines of the individual radiators each of which have one side connected to a common source and the second sides connected to the four parabolic reflectors.

Although the invention has been described with respect to preferred embodiments, it is not to be so limited, as changes and modifications may be made which are within the full intended scope as defined by the appended claims.

I claim as my invention:

1. A ground station antenna for a satellite communications transmission system via a first satellite, which is aligned with its axis is the main beam direction at least approximately to the point determined by the position of the first satellite in geostationary orbit, characterized in that the radiation diagram of the antenna (A,A') has a first 3-dB-beam width of between 0.2° and 2° in a first plane (I), and said first satellite and other satellite are in said first plane and possesses a second 3-dB-beam width of between 2° and 20° in a second plane (II) which is at right angles to said first plane (I), and the ratio of the beam width of the first beam to the second 3-dB-beam being equal to or less than 0.25, and the alignment of the first plane corresponds approximately with the plane established by the antenna axis in the main beam direction and a tangent to the geostationary orbit at the intersection point with the antenna axis and said ground station antenna comprising four parabolic reflectors arranged in a straight line, and four adjustable phase shift devices each having first sides connected to a common source and having second sides connected to separate ones of said four parabolic reflectors for precise alignment of the antenna.

* * * * *